US009799981B2

(12) United States Patent
Weber

(10) Patent No.: US 9,799,981 B2
(45) Date of Patent: Oct. 24, 2017

(54) LOW PROFILE LATCHING CONNECTOR

(71) Applicant: Molex, LLC, Lisle, IL (US)

(72) Inventor: Kenneth A. Weber, Maumelle, AR (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/899,787

(22) PCT Filed: Jul. 7, 2014

(86) PCT No.: PCT/US2014/045590

§ 371 (c)(1),
(2) Date: Dec. 18, 2015

(87) PCT Pub. No.: WO2015/006223

PCT Pub. Date: Jan. 15, 2015

(65) Prior Publication Data

US 2016/0149332 A1 May 26, 2016

Related U.S. Application Data

(60) Provisional application No. 61/843,568, filed on Jul. 8, 2013.

(51) Int. Cl.

| | |
|---|---|
| ***H01R 13/625*** | (2006.01) |
| ***H01R 13/502*** | (2006.01) |
| ***H01R 13/627*** | (2006.01) |
| ***H01R 13/633*** | (2006.01) |

(52) U.S. Cl.
CPC ..... *H01R 13/502* (2013.01); *H01R 13/6275* (2013.01); *H01R 13/6335* (2013.01)

(58) Field of Classification Search
CPC ..... H01R 13/6275; H01R 13/6272
USPC ..... 439/345, 352, 358, 350, 357, 370, 488
See application file for complete search history.

(56) References Cited

U.S. PATENT DOCUMENTS

| | | | | |
|---|---|---|---|---|
| 7,226,307 | B1 | 6/2007 | Chen et al. | |
| 7,354,292 | B1 | 4/2008 | Lloyd et al. | |
| 7,476,117 | B1 | 1/2009 | Chen et al. | |
| 7,771,225 | B1 | 8/2010 | Wu | |
| 7,828,579 | B2 | 11/2010 | Huang | |
| 8,740,637 | B2 | 3/2014 | Wang et al. | |
| 2011/0212643 | A1* | 9/2011 | Reed | H01R 9/038 439/345 |
| 2012/0058665 | A1 | 3/2012 | Zerebilov et al. | |

FOREIGN PATENT DOCUMENTS

| | | | |
|---|---|---|---|
| CN | 102769231 | A | 7/2012 |
| JP | 2001-035592 | A | 2/2001 |

* cited by examiner

*Primary Examiner* — Phuongchi T Nguyen
(74) *Attorney, Agent, or Firm* — Jeffrey K. Jacobs

(57) ABSTRACT

A small, low-profile plug connector for use with electronic devices provides a latching member with a pair of hooks that engage mating holes in a guide frame, and which can be easily disengaged from the guide frame or opposing connector or housing. The connector includes an elongated actuator interposed between the connector housing and latching member and the actuator terminates in a cylindrical cam member that is captured in a recess on the connector housing such that rearward movement of the actuator imparts a raising action to the latching member.

10 Claims, 7 Drawing Sheets

LOW PROFILE LATCHING CONNECTOR

REFERENCE TO RELATED APPLICATIONS

The present application is a national phase of PCT Application No. PCT/US2014/045590, filed Jul. 7, 2015, which in turn claims priority to prior-filed United States Provisional Patent Application No. 61/843,568, entitled "Improved Low Profile Latching Connector," and filed with the United States Patent And Trademark Office on Jul. 8, 2013. The content of the aforementioned Application is fully incorporated herein in its entirety.

BACKGROUND OF THE PRESENT DISCLOSURE

The Present Disclosure is generally directed to small and low-profile connectors, and more particularly, to pluggable-style connectors received within a housing, or guide frame, and which have an improved actuating mechanism for actuating an exterior latch to engage or disengage the connector in mated engagement with the housing or guide frame.

Small and low-profile connectors, such as those used in SFP (Small Form Factor Pluggable) applications, are desired in electronic devices in which space is a premium. Such connectors are widely used to make connections with routers and servers, and are small in size. One problem with electronic connectors of this type, however, is the tendency for them to separate or be disconnected from the component to which they are connected. Connectors, and particularly plug connectors, rely upon latching mechanisms to make their connection more reliable and separation less likely. As connectors become smaller and as the density of receptacle connectors in electronic devices increases, the simple act of disengaging a plug connector latch mechanism becomes increasingly more difficult.

U.S. Pat. No. 7,354,292, which issued Apr. 8, 2008 to the assignee of the Present Disclosure and the content of which is hereby incorporated by reference in its entirety herein, describes a plug connector in which the latching mechanism includes a cantilevered latching member actuated by way of a pull tab having an integrated roll pin. The pull tab is formed of nylon and prevented from over-pulling by way of a slot-tab arrangement. A lug on the connector housing is received within a slot of the pull tab and is intended to limit the movement, and prevent over-movement of the pull tab. However, the nylon material from which the pull tab is made is subject to deformation and repeated usage of the pull tab may result in an elongation of its slot, which can eliminate the ability of the pull tab to return the latching mechanism to its initial location. Exertion of excessive force on the pull tabs of these known connectors has resulted in damage to the actuator and has required replacement of the actuator.

The Present Disclosure is directed to a small size, and low profile pluggable connector that overcomes the aforementioned shortcomings.

SUMMARY OF THE PRESENT DISCLOSURE

Accordingly, there is provided a low profile connector with a latching mechanism that secures it to an opposing receptacle. In this regard, a low profile plug connector usable in high-density electronic devices is provided wherein the latching mechanism is simple to assemble and operate, using a minimum number of components and a structure that prevents elongation of the pull tab to the extent and possible deleterious operation of the latching mechanism.

In accordance with the Present Disclosure, a connector for mating with a guide frame or other housing that houses a receptacle connector is provided with a connector housing that houses a circuit card which supports a plurality of conductive contacts thereon. The contacts are terminated to conductors in a cable, and the connector housing includes a forward mating end received within a portion of the guide frame. The connector housing further includes a rear body portion that remains exterior of the guide frame and the connector housing forward mating end and rear body portion are aligned together along a longitudinal axis of the connector housing. A latching mechanism is disposed on the connector housing, primarily on the body portion thereof, and has a cantilevered structure responsive to a pulling action on an actuator that disengages a latching arm of the latching mechanism from engagement with the opposing guide frame.

The connector housing body portion has a slot that receives a substantial portion of the latching mechanism, and the latching mechanism has an elongated latching arm that extends lengthwise of the connector housing. Two wing portions of the latching mechanism are fixed to the connector housing so that the latching mechanism acts as a cantilevered member. The free end of the latching arm may include one or more hooks that engage openings in the opposing guide frame, or housing, that encloses the opposing receptacle connector. The latching member includes a cam surface that extends rearwardly and a sliding actuator is provided to operate the latching mechanism upwardly so that a user may lift the latching member with a simple pull action. The actuator is interposed between the latching arm and an exterior surface of the connector housing. The actuator takes the form of a pull tab wrapped around a roll pin which defines a cam member of the actuator. The roll pin is captured in a recess disposed on the connector housing and this recess limits the movement of the roll pin lengthwise with respect to the connector housing. The latching member cam surface is angled in a manner so that the cantilevered arm of the latching member exerts a force on the actuator cam member when it is pulled and this force tends to return the actuator cam member to its original position where the latching member is in its downward position. Maintaining the cam surface in the connector housing contributes to the reduction in the height of the connector.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
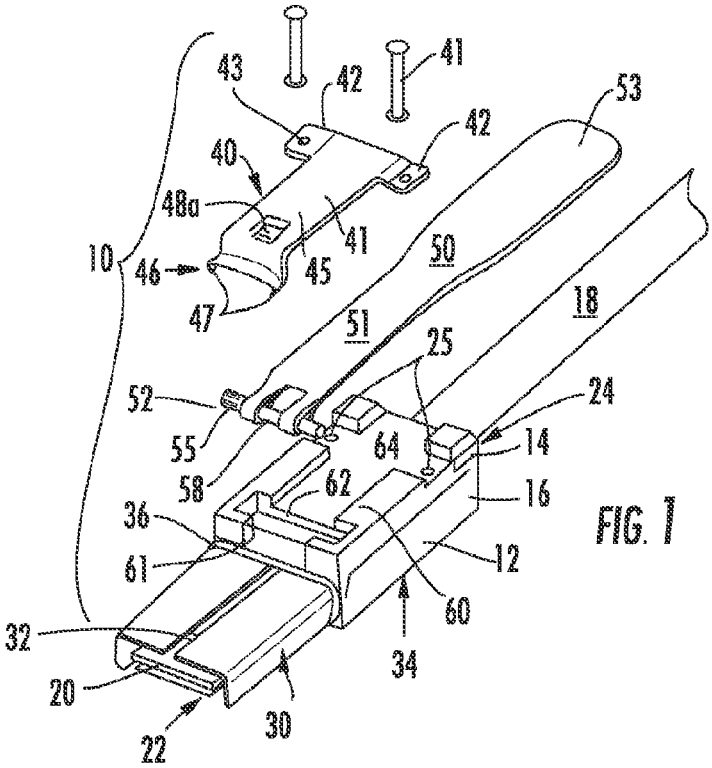
FIG. 1 is an exploded perspective view of a low profile plug connector constructed in accordance with the Present Disclosure.
Figure 1A:
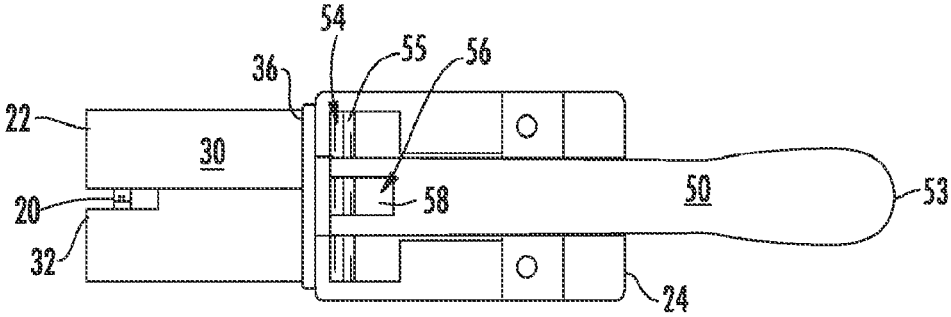
FIG. 1A is a top plan view of a portion of the connector of FIG. 1, with the actuator and cam member in place upon the connector housing rear portion.
Figure 1B:
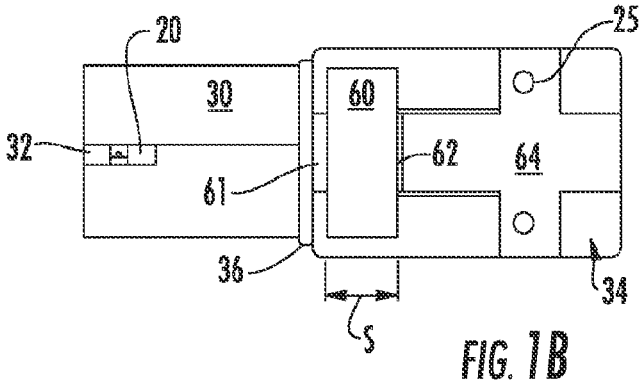
FIG. 1B is the same view as FIG. 1A, but with the actuator and cam member removed to illustrate the connector housing rear portion recess and actuator channel.

FIG. 1 is an exploded view of a low profile connector 10 constructed in accordance with the Present Disclosure. The connector 10 has a connector housing 12 formed from two parts 14, 16 and defines a hollow interior that receives one end of a multi-wire cable 18 and receives a portion of a circuit card 20 that defines a mating blade of the connector 10. The connector housing 12 includes opposing first and second (front and rear) ends 22, 24 and the front end 22 thereof is configured to mate with the receptacle or guide frame 70 of an opposing receptacle connector 71 (FIG. 6C), while the rear end 24 is configured to receive the cable 18.

Figure 6A:
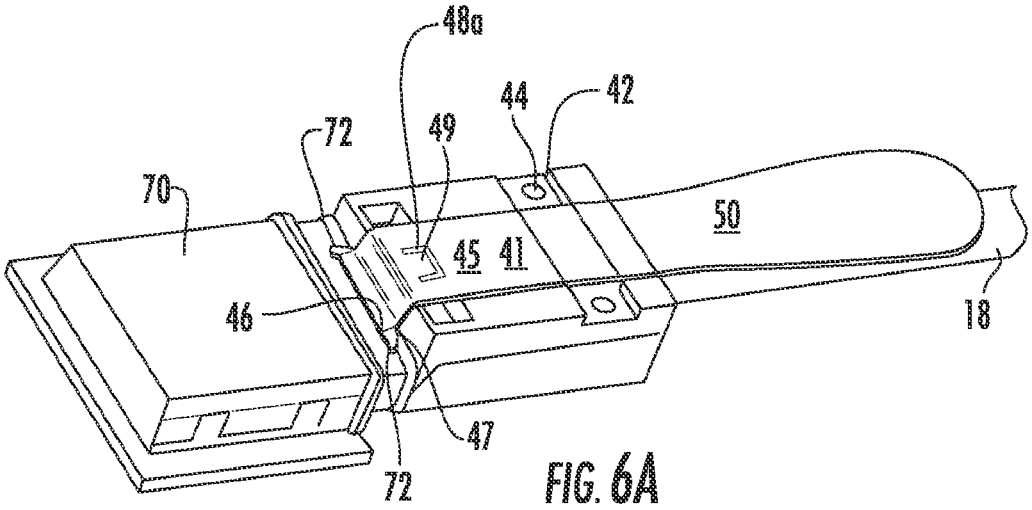
FIG. 6A is a perspective view of the connector of FIG. 1 engaged with an opposing connector assembly mounted to a circuit board.
Figure 6B:
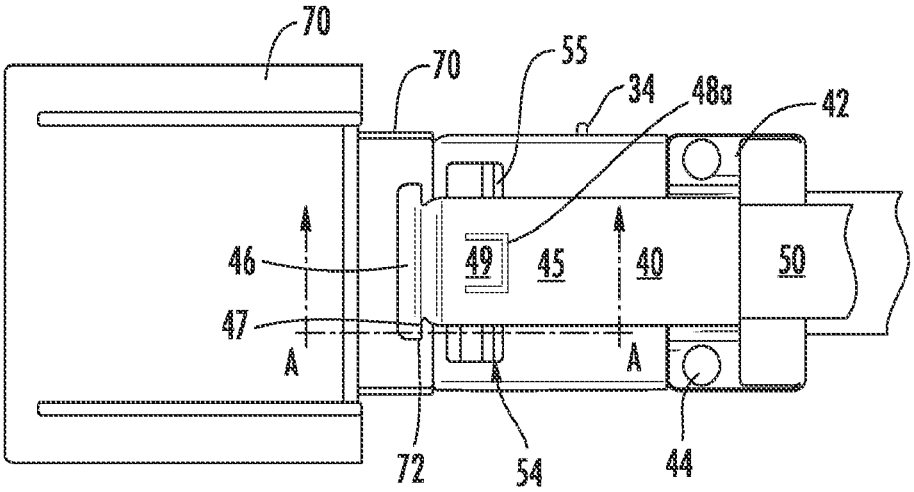
FIG. 6B is a top plan view of the mated connector assembly of FIG. 6A.
Figure 6C:
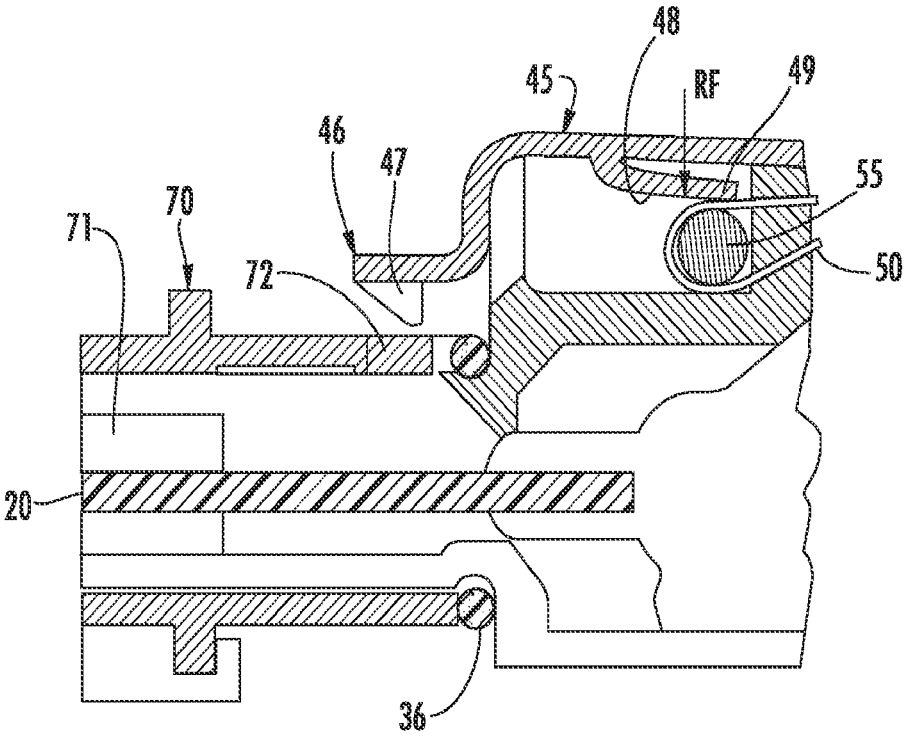
FIG. 6C is an enlarged cross-sectional detail view of the mated connector assembly of FIG. 6B, taken along Line A-A thereof.

The connector housing 12 can be seen to have two different portions. The first, or front, portion, 30 engages an opposing connector assembly as noted above, but also provides a protective housing for the circuit card 20 and may further include a polarizing slot 32 to effect proper mating with the apposing connector. The second, or rear, portion, 34 is larger than the first portion both in overall size and in height, which gives the connectors of the Present Disclosure a somewhat stepped appearance when viewed from the side. A flexible EMI gasket 36 may be provided that encircles the first portion 30 and which sits at the junction of the connector housing first and second portions 30, 34 so that it may be compressed when the connector 10 is mated with the guide frame 70 of the opposing connector assembly (FIGS. 6A-B).

Figure 3A:
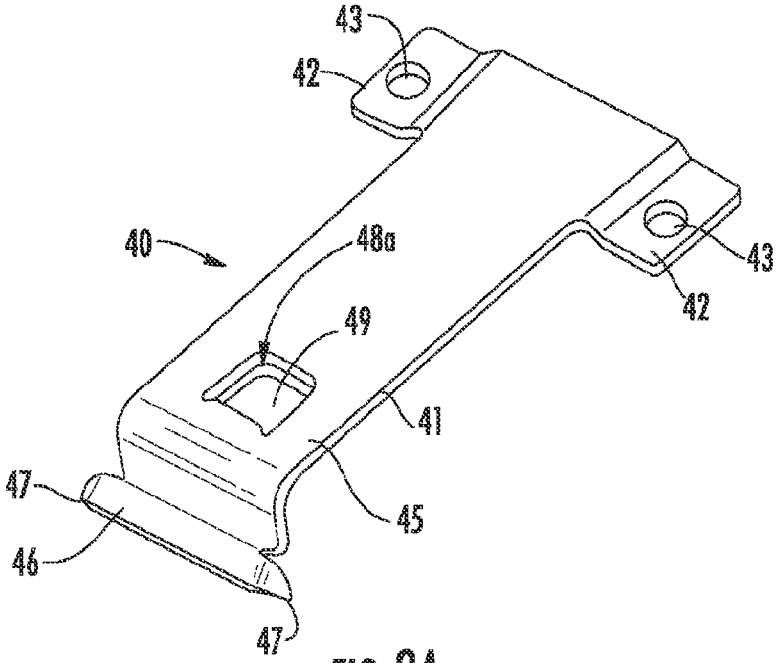
FIG. 3A is a perspective view of the latching member utilized in the plug connector of FIG. 1.
Figure 3B:
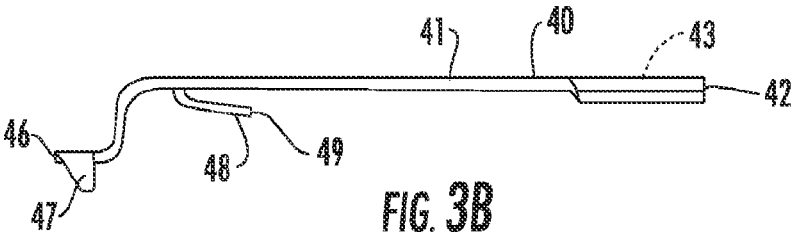
FIG. 3B is a side elevational view of the latching member of FIG. 3A.

A latching member 40 is provided and it can be seen in FIGS. 3A-B to have a generally T-shaped configuration, with an elongated base portion 41 and two wing portions 42 that extend at an angle from the base portion 41. The wing portions 42 are perforated with openings 43 that accommodate rivets, or other suitable fasteners 44. As the wing portions 42 are only fixed to the connector housing 12 by their respective fasteners 44, a singular latching arm 45 is defined and extends lengthwise of the latching member 40. The latching arm 45 terminates in a free end 46 that is free to move up or down in response to movement of the actuator 50. The free end 46 of the latching member 40 has one or more engagement members in the form of hooks 47 configured to engage corresponding opposing openings 72 formed in the opposing connector assembly. As noted above, the latching member 40 is secured at its rear wing portions 42 and so presents a cantilevered latching arm 45 that can be selectively urged upwardly and downwardly in order to disengage and engage the latching hooks 47 from the opposing connector assembly.

The fasteners 44 maintain the latching member and its associated latching arm in a closed, or engagement, position where the latching arm engagement hooks will engage the openings 72 of an opposing guide frame 70. The latching member 40 and its latching arm 45 will deflect upwardly upon pulling of an actuator 50 and the cantilevered attachment of the latching member 40 urges it downwardly against the pull of the actuator 50 as explained in greater detail below.

Figure 2A:
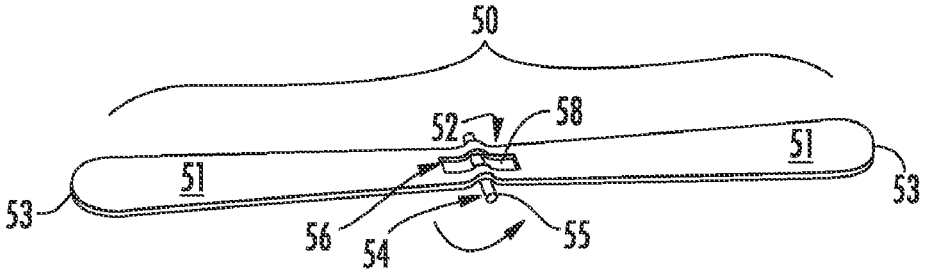
FIG. 2A is a perspective view of the actuator utilized in the connector of FIG. 1 prior to assembly onto a roll pin.
Figure 2B:
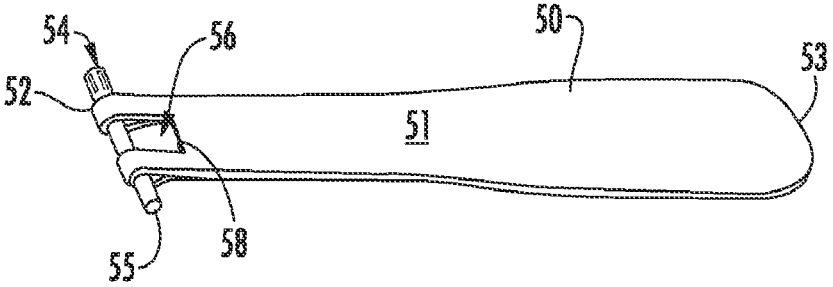
FIG. 2B is the same view as FIG. 2A, but illustrates the two halves of the pull tab portion of the actuator in contact with each other so as to grip the roll pin at one end thereof.

As noted above, the actuator 50 is provided to lift the latching member free end 46 by way of a simple pulling action. FIGS. 2A-B depict the actuator 50 and it can be seen that the actuator has an elongated body portion 51 with opposing front and rear ends 52, 53. The actuator 50 is formed from a strip of durable material, such as PET or the like, and is folded upon itself, preferably at a midpoint to provide a double thickness strip for the actuator 50. The two sides of the actuator strip may be united by way of plastic or ultrasonic welding, adhesives, or the like. The actuator 50 is also folded upon itself so that it can encircle and grasp a cylindrical cam member 54 shown as a roll pin 55, at the actuator front end 52. The is roll pin is preferably formed from a metal as to prevent wear problems from occurring during repeated installation and removal of the connector 10. A window 56 is provided in the middle of the actuator 50, that when the body portion 51 is folded over the roll pin 55, defines a slot 58 positioned generally in the center part of the actuator 50 between the two opposing ends of the roll pin 55. The rear end 53 of the actuator 50 may be wider than the front end 52 so that the grasping of it by a user is facilitated. The actuator 50 has a length longer than the connector housing second portion 34 so that it can project rearwardly for access in a wiring closet or the like.

FIGS. 3A-B illustrate the latching member 40. In order to provide a means for urging the latching member 40 up or down in response to movement of the actuator 50, the latching member 40 is provided with a cam surface 48 disposed generally centrally in the latching arm 45 and proximate to the latching arm free end 46. This cam surface 48 may be easily stamped from the body of the latching arm 45 and is partly defined by a surrounding U-shaped window 48*a*. The window 48*a* is preferably oriented so that the opening of the "U" faces the latching arm free end 46. In this regard, a tab 49 is defined by the cam surface 48 and in the embodiment illustrated, the tab 49 is bent downwardly at an angle and rearwardly toward the wing portions 42 of the latching member 40. The angle of this cam surface 48 serves to exert a return force on the actuator cam member 54 as the rear end of the latching member 40 is fixed to the connector housing 12 by way of the fasteners 44 at the wing portions 43 thereof. The latching arm 45 is therefore free to deflect upwardly and downwardly.

Figure 4A:
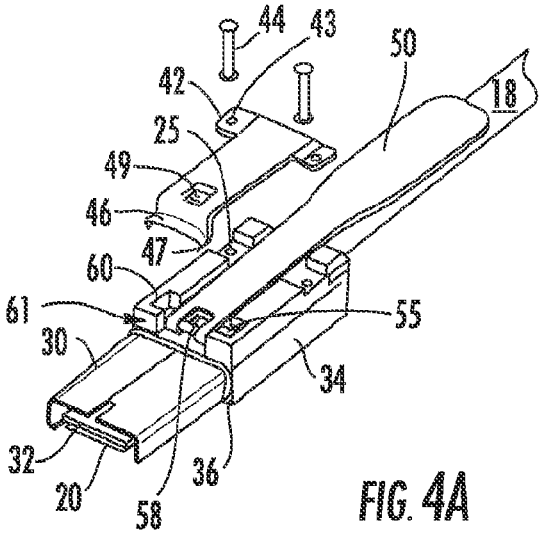
FIG. 4A is a perspective view of the plug connector of FIG. 1, but with the actuator in place on the connector housing.
Figure 4B:
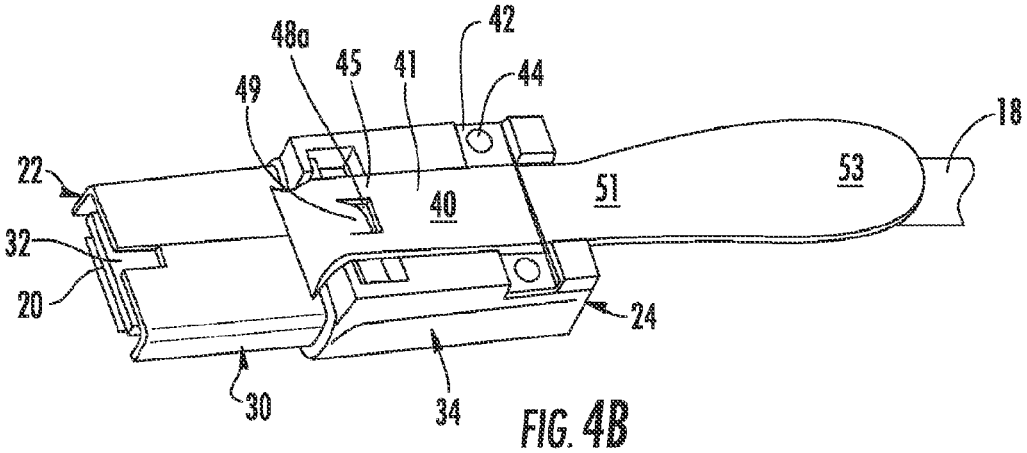
FIG. 4B is the same view as FIG. 4A, but with the latching member assembled to the connector housing and the actuator roll pin in its forward position.
Figure 4C:
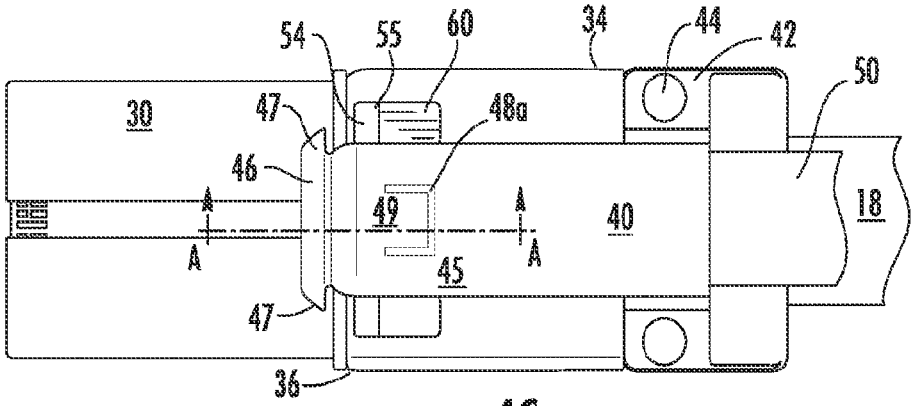
FIG. 4C is an enlarged portion of a top plan view of the connector of FIG. 4B.
Figure 4D:
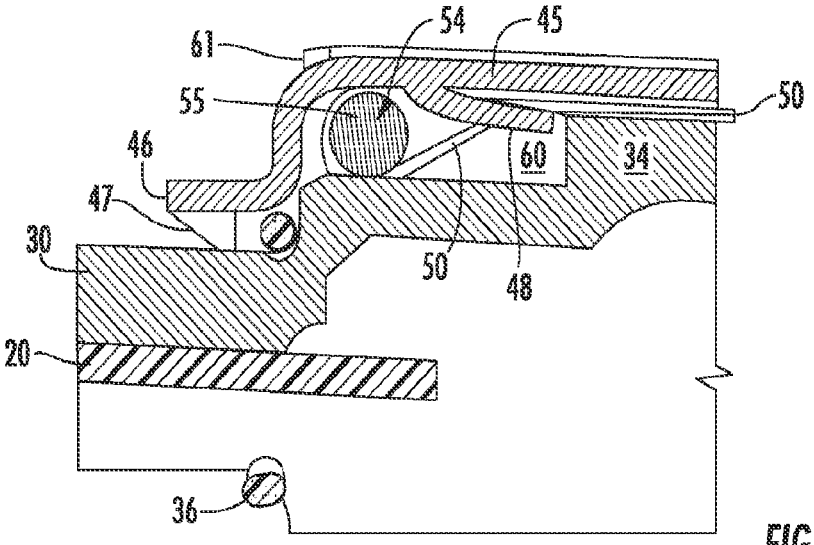
FIG. 4D is a sectional view taken along Line A-A of FIG. 4C, illustrating the forward position of the actuator roll pin in the connector housing recess.
Figure 5A:
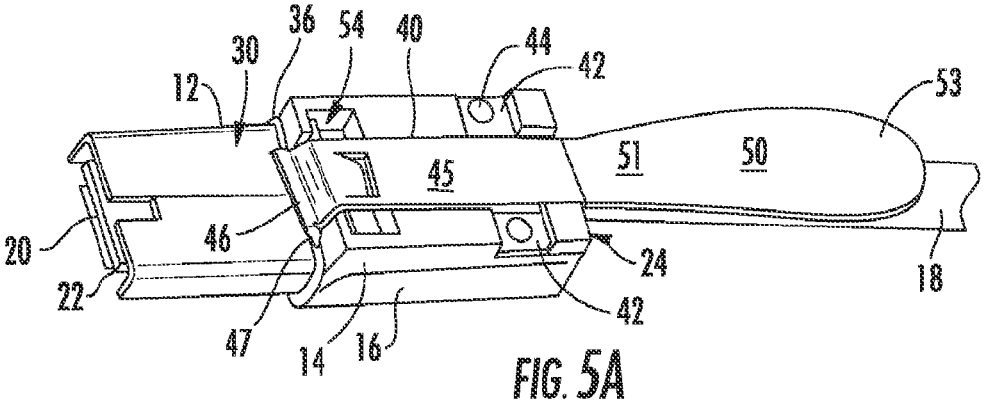
FIG. 5A is a perspective view similar to FIG. 4B, but with the actuator roll pin moved to its rearmost position within the connector housing recess.
Figure 5B:
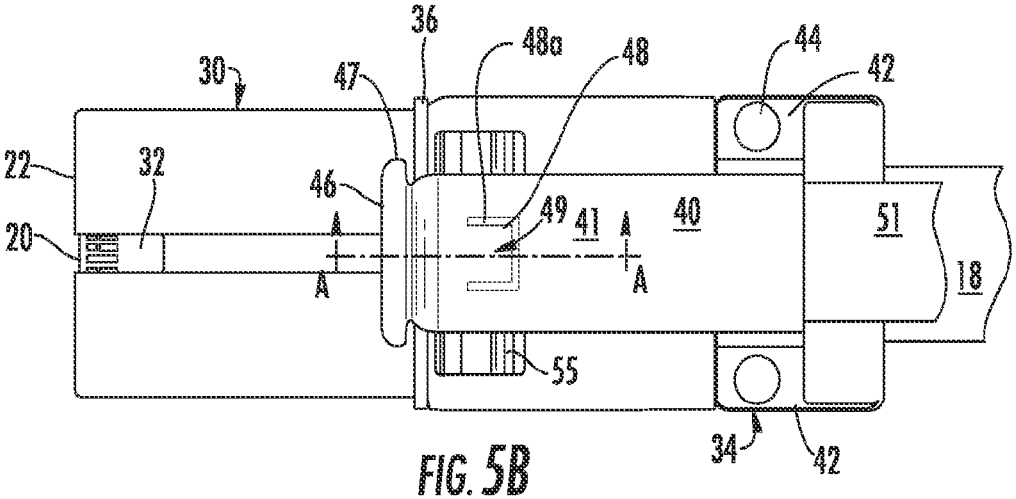
FIG. 5B is an enlarged top plan view of the latching member of FIG. 5A with the associated actuator in its rear most position within the connector housing.
Figure 5C:
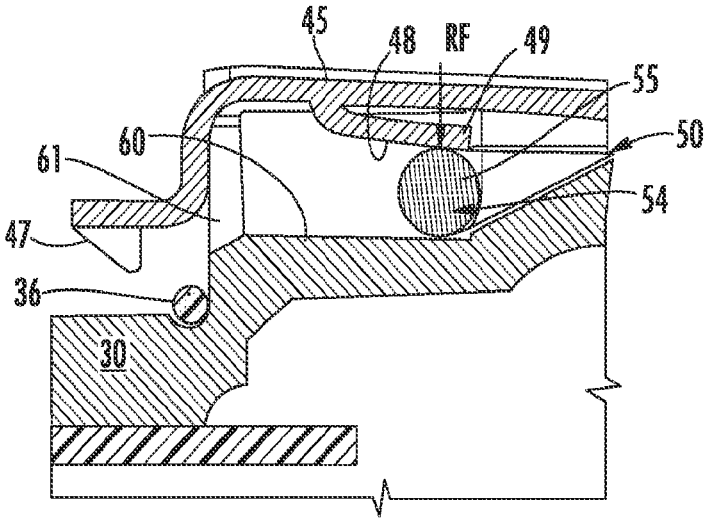
FIG. 5C is a sectional view taken along Line A-A of FIG. 5B, illustrating the roll pin in its rearmost position within the connector housing recess so that the free end of the latching arm is lifted up.

The upward deflection of the latching arm 45 occurs when the actuator 50 is pulled in a first direction, rearwardly, and the actuator cam member 54 moves from its first operative position shown in FIG. 4D at the front end of the connector housing recess 60 to its second operative position shown in FIG. 5C. When this occurs, the latching arm engagement hooks 47 are lifted out of the opposing guide frame openings 72 and the connector 10 may be removed from the guide frame 70. The latching member cam surface extends down at an angle in a second direction angularly offset from the pulling (first) direction. As the latching arm free end tends to return to its downward, or engaged position, the downwardly angled cam surface exerts a return force, shown by the arrow RF in FIGS. 5C and 6C onto the roll pin 55. This causes the roll pin 55 to move forwardly in the connector housing recess 60 when the pulling on the actuator is relaxed. By this structure, the cam surface of the latching member 40 is maintained in the connector housing recess 60, reducing the overall height of the connector assembly.

The tab 49 and its angled, or ramped, cam surface 48 has a width that permits it to extend through the slot 58 defined at the front end 52 of the actuator 50. The use of the actuator window 56 results in the actuator exerting a pulling force on the roll pin 55 on opposite sides of the latching member cam surface 48, and it also extends the roll pin 55 into direct contact with the latching member cam surface 48 so that this contact is purely metal-to-metal contact. Hence, there is no worry about degradation of one of the cam member/cam surface members due to dissimilar materials as which may occur with conventional plastic-metal interfaces.

As illustrated best in FIGS. 1 and 4A, the connector housing second portion includes a recess 60 formed proximate to the front portion thereof. This recess 60 is rectangular in configuration and extends widthwise of the connector housing 12. The recess 60 has a selected length that corresponds to a desired movement length, or stroke "S," of the actuator 50 in which the roll pin 55 moves into contact with the latching member cam surface 48 and vice-versa. The recess 60 has a pair of opposing slots 61, 62 that respectively open to the front and rear ends of the connector housing second portion. The front slot 61 accommodates the latching arm free end, while the recess rear slot 62 accommodates part of the body of the latching arm. The recess front slot 61 communicates with the exterior of the connector 10, while the recess rear slot 62 communicates with the connector housing rear portion channel 64. The recess rear slot 62 communicates with a lengthwise channel 64 formed in the top surface of the connector housing second portion 34 and this channel 64 accommodates a portion of the actuator.

The recess 60 serves to capture the roll pin 55 and restrain its movement to the desired stroke S. The length of the stroke is preferably such that it maintains the actuator cam member 54 in contact with the latching member cam surface 48 and also provides a stop for rearward movement of the roll pin 55 so that the actuator 50 cannot be pulled beyond the stroke. It also accommodates the actuator front end 52 and its associated slot 58, as well as the latching member cam surface 48, the tab 49 of which extends through the actuator slot 58 toward the bottom of the recess 60. Both the latching member cam surface tab 49 and the actuator slot 58 have widths that are preferably less than the width of the recess 60 and the width of the connector housing rear portion channel 64. Similarly, it is preferable that the lengths of the actuator slot 58 and the latching member cam surface tab 49 are less than or approximately equal to the length of the connector housing rear portion recess 60 in order to is confine, or capture, the camming movement within the recess 60. By capturing the movement of the roll pin 55 in the recess 60, the roll pin 55 is maintained in contact with the latching member cam surface 48 to ensure an application of the return force to move the roll pin 55 back to its first operative position when the pulling force on the actuator 50 is released.

While a preferred embodiment of the Present Disclosure is shown and described, it is envisioned that those skilled in the art may devise various modifications without departing from the spirit and scope of the foregoing Description and the appended Claims.

What is claimed is:

1. A connector, comprising:

a connector housing having a front portion and a rear portion, the front portion being sized to fit within a mating receptacle and having a first surface, the rear portion having a second surface disposed on the connector housing, the first and second surfaces being disposed in different planes;

a latching member including a first end attached to the rear portion second surface, a second end at least partially extending over the front portion first surface, and a cam surface disposed between the latching member first and second ends;

an actuator at least partially interposed between the latching member and the connector housing and extending lengthwise along the connector housing, the actuator including a cam member disposed at a first end thereof, the cam member being a roll pin formed separately from the actuator, the cam member being captured in a recess disposed in the connector housing and being movable between first and second operative positions wherein the actuator comprises an elongated flexible strip folded over the cam member and onto itself so as to secure the cam member, the cam surface being at least partially disposed in the recess such that pulling on the actuator in a first direction causes the cam member to move from the first operative position to the second operative position, whereby the cam member contacts the cam surface and lifts the latching member upwardly away from the first surface.

2. The connector of claim 1, wherein the cam surface extends at an angle such that rearward movement of the actuator and roll pin causes the free end to lift upwardly, and the cam surface exerts a return force on the roll pin.

3. The connector of claim 1, wherein the recess and the cam member are wider than the cam surface.

4. The connector of claim 1, wherein the cam surface extends in a second direction, angularly offset from the first direction to remain in contact with the cam member when pulled.

5. The connector of claim 1, wherein the cam surface extends downwardly and rearwardly from the latching member, and terminates in a free end that extends into the connector housing recess.

6. The connector of claim 5, wherein the actuator includes a slot disposed therein proximate the recess and the cam surface extends at least partially through the slot.

7. The connector of claim 6, wherein the cam surface has a width less than a corresponding width of the latching member.

8. The connector of claim 1, wherein the latching member has a T-shaped configuration with an elongated base and two wings, the base extending along the rear portion over the recess.

9. The connector of claim 8, wherein the cam surface is disposed on the base and extends toward the wings.

10. The connector of claim 8, wherein the rear portion includes a lengthwise channel and the actuator is disposed in the channel and the cam member is disposed in the recess.

* * * * *